United States Patent [19]

Strasser

[11] Patent Number: 5,020,218

[45] Date of Patent: Jun. 4, 1991

[54] METHOD FOR MANUFACTURING A REFRIGERATOR COLD HEAD HOUSING

[75] Inventor: Wilhelm Strasser, Bergisch-Gladbach, Fed. Rep. of Germany

[73] Assignee: Leybold Aktiengesellschaft, Fed. Rep. of Germany

[21] Appl. No.: 374,472

[22] Filed: Jun. 30, 1989

[30] Foreign Application Priority Data

Jul. 1, 1988 [DE] Fed. Rep. of Germany ..... 3822239

[51] Int. Cl.[5] ..... B23P 15/26

[52] U.S. Cl. ..... 29/890.035; 29/890.054; 228/184

[58] Field of Search ..... 72/347, 349; 29/527.1, 29/890.054, 890.035; 228/60, 184; 62/6

[56] References Cited

U.S. PATENT DOCUMENTS

| | | | |
|---|---|---|---|
| 3,736,761 | 6/1973 | Richmond et al. | 62/6 |
| 4,397,156 | 8/1983 | Heisig et al. | 62/6 |
| 4,427,028 | 1/1984 | Jacobellis | 228/184 |
| 4,541,265 | 9/1985 | Dye et al. | 72/347 |

FOREIGN PATENT DOCUMENTS

| | | | |
|---|---|---|---|
| 3037458 | 4/1982 | Fed. Rep. of Germany . | |
| 3705701 | 9/1988 | Fed. Rep. of Germany | 228/184 |
| 886202 | 1/1962 | United Kingdom | 29/159.3 |

OTHER PUBLICATIONS

Textbook of Deformation Technology, by K. Lange, pp. 18–19, Springer Berlag, 1972.

Non-Cutting Shaping, 4th Ed. by J. Flimm, pp. 203–204, Carl-Hanser Verlag, undated.

Handbook of Production Technology, pp. 1138–1140, and 1226–1233, Carl Hanser Verlag, 1985.

Sheet Metal Pipes and Profiles (periodical), pp. 14–16, 1986.

*Primary Examiner*—P. W. Echols

*Assistant Examiner*—David P. Bryant

*Attorney, Agent, or Firm*—Hill, Van Santen, Steadman & Simpson

[57] ABSTRACT

The invention is directed to a method for manufacturing a cylindrical refrigerator housing (2) of a refrigerator cold head composed of a plurality of parts to be connected to one another. To simplify the manufacturing method and reduce the deterioration of the efficiency of the refrigerator due to the application of heat via the refrigerator housing, it is proposed that at least the housing section (1) of the refrigerator housing (2) that encompasses the cylinder wall is manufactured by a cold-working process, for example by ironing, stretching pressure rolling or deep-drawing.

11 Claims, 2 Drawing Sheets

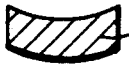
FIG. 2a
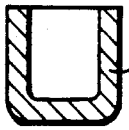
FIG. 2b
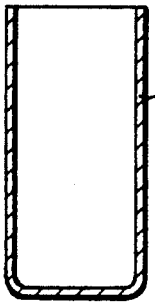
FIG. 2c
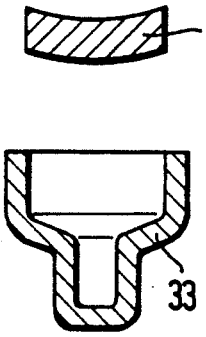
FIG. 3a
FIG. 3b
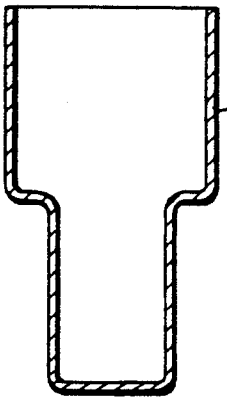
FIG. 3c
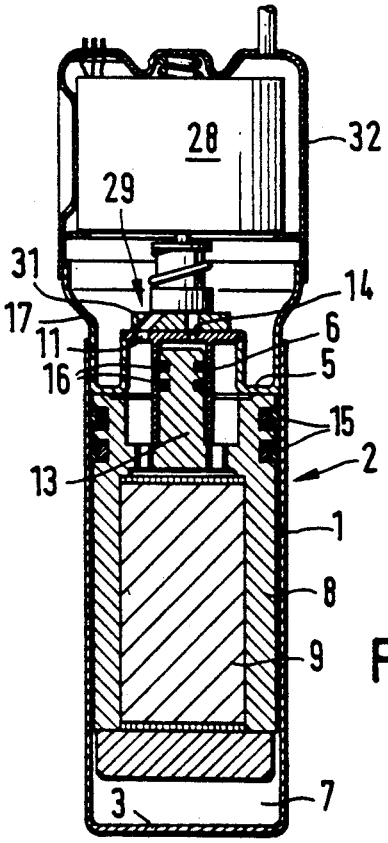
FIG. 2d
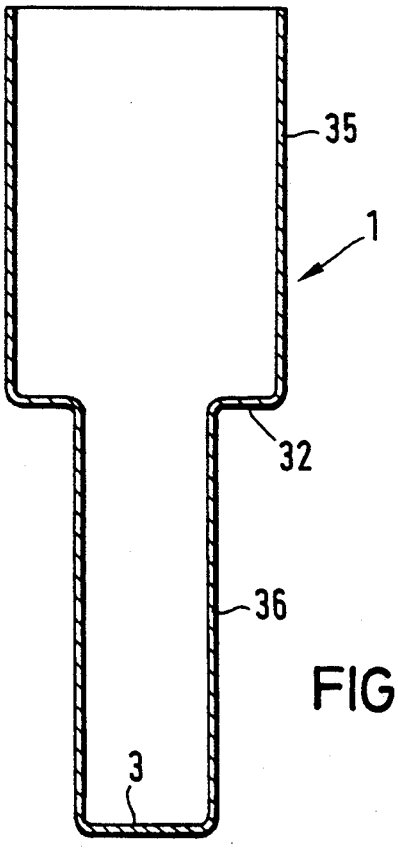
FIG. 3d

METHOD FOR MANUFACTURING A REFRIGERATOR COLD HEAD HOUSING

TECHNICAL FIELD

The invention is directed to a method for the manufacture of the refrigerator housing of a refrigerator cold head. The present invention is also directed to a refrigerator housing manufactured according to this method.

BACKGROUND OF THE INVENTION

Refrigerators are low-temperature refrigerating machines that perform sequential thermodynamic cyclic-process (see, for example, U.S. Pat. No. 2,906,101). A one-stage refrigerator includes a chamber having a displacer. The chamber is connected to a high-pressure gas source and to a low-pressure gas source in alternation, so that sequences of a thermodynamic cyclic process (Stirling process, Gifford/McMahon process) occur during the reciprocating motion of the displacer. The consequence is that heat is withdrawn from a specific region of the chamber. For example, temperatures down to below 10 K. can be produced with two-stage refrigerators of this type and with helium as the working gas.

What is referred to as the cold head is that part of a refrigerator that is essentially composed of the actual refrigerator (housing with displacer) and of a gas control system (see German OS 30 44 427). In a known fashion, the gas control system includes a valve system that connects the high-pressure gas source and the low-pressure gas source with the gas channels in a defined sequence. When the refrigerator is fashioned in two stages, two displacers are present that are accommodated in a two-stage cylinder or refrigerator housing. German OS 32 01 496 discloses the possibility of fashioning the gas control system and the refrigerator as separate component parts. This structure is typically known as a split cold head.

The previously known structure of the refrigerator housing is exemplified by German OS 30 44 427. It is composed of a cylinder section that is manufactured of raw material by machining operations (turning, grinding, honing or the like). The cylinder section has the following functions:

formation of the working space;
tight enclosure of the helium gas;
optimally friction-free guidance of the displacer;
track for the seals;
low heat conduction; and
compressive strength up to about 30 bar working pressure.

The material utilized and the processing are involved and expensive in the manufacturing method of the prior art, since precise thin wall tubes having a high interior surface quality must be manufactured. For strength reasons, the wall thickness of the cylinder tubes manufactured using these processes cannot fall below 1 mm, this simultaneously meaning that the heat conduction along the cylinder tube cannot fall below a defined degree. The level of heat conduction inherent in these processes deteriorates the efficiency of the refrigerator, since heat is constantly supplied to the cold end of the cylinder via the cylinder housing itself.

SUMMARY OF THE INVENTION

The present invention relates to a refrigerator housing for a refrigerator cold head, wherein a cold-working process (such as ironing, stretching pressure rolling, or deep drawing) is used to reduce wall thickness and simplify manufacture. The refrigerator housing has at least one cylindrical wall, and may be manufactured to accommodate either a one-stage or two-stage refrigerator. Depending upon the process chosen, the housing may have a weld floor, or be manufactured as a continuous, integral unit.

It is therefore a primary object of the present invention to provide a refrigerator housing that, by virtue of having been manufactured by a cold working process, has a wall thickness no greater than 0.8 mm.

Another object of the invention is to provide a closure for an end-face of the refrigerator housing that is attached by soldering or welding.

Yet another object of the invention is to provide a refrigerator housing that has a cylindrical wall with a floor at one end, and manufacturing both as a continuous, integral unit.

It is a further object of the invention to provide a refrigerator housing having two cylindrical sections of unequal diameter joined by a step section, with the refrigerator housing being closed by a floor that is manufactured as a continuous, integral unit with the housing.

It is yet another object of the invention to provide the housing with an annular fitting piece and a pot-shaped part to close the end opposite the floor.

It is yet another object of the invention to provide a method for welding together the cylindrical wall, the annular fitting piece, and the pot-shaped part so that repeated parting and rewelding of these parts can occur.

It is a further object of the invention to provide a potshaped part that acts as a guide cylinder for a drive piston provided at a displacer of the refrigerator cold head.

These and other objects are inventively achieved in that at least that housing section of the refrigerator housing that encompasses the cylinder wall is manufactured with a cold-working process, for example with ironing, stretching pressure rolling, or deep-drawing. An important advantage of this measure is that additional strengthening of the material, preferably stainless steel, arises as a consequence of the cold-working, so that the wall thickness can be reduced by at least 20% (i.e., no greater than 0.8 mm). The cross-sectional area of the cylinder section also decreases by at least 20% as a result thereof, so that the heat flow from the warm end to the cold end of the refrigerator housing is likewise reduced. Further, the proposed manufacturing method is significantly simpler, and losses of material due to machining processing are eliminated. When ironing processes are used in accordance with the present invention, there is the possibility of forming a floor simultaneously with the manufacture of the cylinder section, so that soldered connections or welded connections in this region are eliminated. The recited cold-working processes allow the manufacture of component parts having high dimensional accuracy and surface quality. The invention involves a cost-saving that justifies the complete replacement of simple cold heads (throwaway cold heads) at the end of their service life.

For the end-face closure of the cylindrical housing, specific parts are expediently manufactured by deep-drawing; the parts forming the housing are soldered or welded to one another. These measures can likewise result in reducing the cost of the manufacturing method of the refrigerator.

Further advantages and details of the invention shall be set forth with reference to exemplary embodiments shown in the figures.

BRIEF DESCRIPTION OF THE DRAWINGS

FIGS. 2*a* through 2*d* are side sectional views showing a cylindrical section manufactured by ironing for use in a refrigerator housing constructed in accordance with the principles of the present invention.

FIGS. 3*a* through 3*d* are side sectional views showing a refrigerator housing for a two-stage refrigerator constructed in accordance with the principles of the present invention.

DESCRIPTION OF THE PREFERRED EMBODIMENT

Figure 1A:
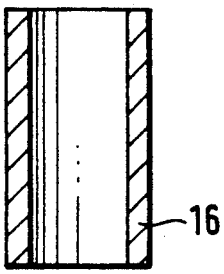
FIGS. 1*a* through 1*c* are side sectional views showing steps in the manufacture of a cylindrical section by stretching pressure rolling for use in a refrigerator housing constructed in accordance with the principles of the present invention.
Figure 1B:
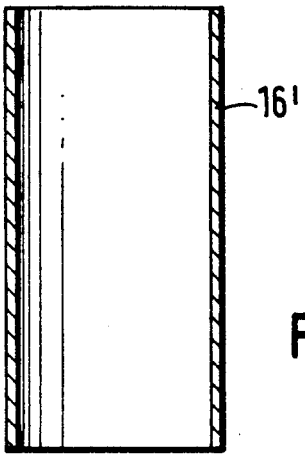
Figure 1C:
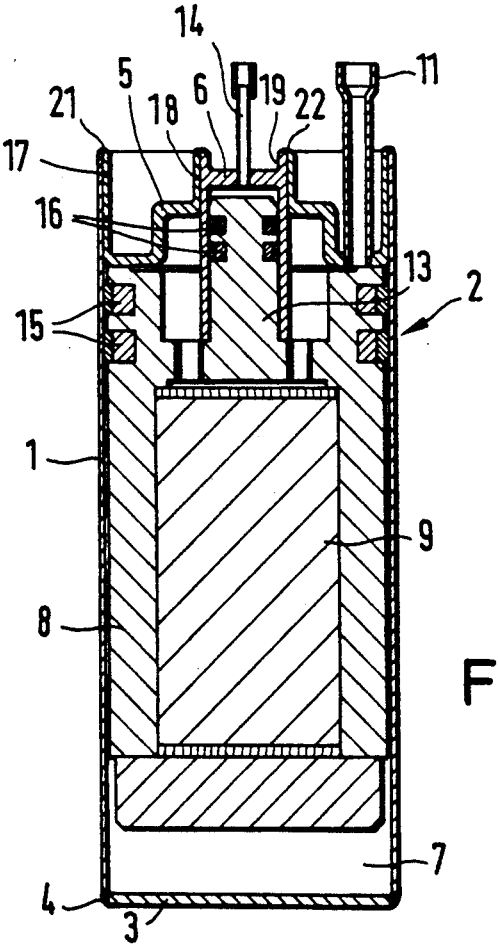

As shown in FIG. 1*c*, the housing of a refrigerator 2 includes a cylinder section 1, a welded floor 3 (weld 4), an annular fitting part 5 and a central, pot-shaped component 6. These housing parts form the work space 7 of the displacer 8 that executes a reciprocating motion during the operation of the refrigerator in cooperation with the regenerator 9 situated inside the displacer.

A line section 11 that penetrates the annular fitting piece 5 is provided for supplying the work space 7 with working gas, this line section 11 being alternatingly connected to a high-pressure gas source and to a low-pressure gas source. The pot-shaped component 6 forms a guide cylinder for a drive piston 13 provided at the displacer 8. A further line 14 that is likewise charged with high-pressure gas and with low-pressure gas in alternation discharges into the guide cylinder. Seal systems for tight guidance of the displacer 8 and of the working piston 13 in their respective cylinders are shown at 15 and 15'.

The cylinder section 1 is formed from a tube section 16 that can be in turn manufactured from, for example, rolled sheet metal. The widened and calibrated initial tube 16 is shaped by stretching pressure rolling to form the cylinder section 1. This process occurs in a known fashion with the assistance of pressure rollers that effect a reduction of the wall thickness and, thus, an enlargement of length and diameter. FIG. 1*b* shows a transition form referenced 16'. Surprisingly, this relatively economical manufacturing method is so precise that is immediately suitable for the manufacture of cylinder sections for refrigerator housings, i.e., without the need for machining re-working.

The annular fitting piece 5 is expediently produced by deepdrawing. Ironing set forth farther below is particularly suited for the manufacture of the pot-shaped component 6.

The two component parts 5 and 6 are equipped with axially extending edges 17, 18 and 19. This structure enables a face-end welding of the fitting piece 5 to first, the cylinder section 1 (edge 17, weld 21) and, second, to the central guide component 6 (edges 18, 19, weld 22). The axial extent of that edge 17 of the fitting piece 5 lying against the cylinder section 1 is selected so that it is relatively large. The end-face arrangement of the weld 21 and the relatively large edge 17 allow a repeated parting and re-welding of the housing parts 1 and 5. When higher-quality cold heads are involved, it is thus easy to open the refrigerator 2 and to replace worn components. The refrigerator 2 is subsequently re-closed by welding.

FIGS. 2*a* through 2*d* illustrate the manufacture of the cylinder section 1 of the refrigerator 2 by ironing. Intermediate forms 26, 27 (FIGS. 2*b*, 2*c*) arise from a slug 25 (FIG. 2*a*) with the assistance of male dies and hollow female dies. In its final form, such a component part simultaneously forms the cylinder section 1 and the floor 3 of the housing of the refrigerator 2 A separate weld in this region is eliminated. This manufacturing method is also surprisingly so precise that machining re-working is no longer required.

In the exemplary embodiment shown in FIG. 2*d*, the refrigerator 2 is equipped with a gas control. A turning valve 29 driven by a motor 28 is allocated to the feeds 11 and 14. The rotating control element 31 is equipped with bores (not referenced in detail) that have a configuration corresponding to the desired gas supply. The motor 28 is accommodated inside a housing section 32 that is secured to the lengthened and expanded edge 17 of the fitting piece 5.

A particular advantage of employing the ironing method lies in the manufacture of cold head housings for two-stage refrigerators. FIGS. 3*a* through 3*d* show this. It is thus possible to manufacture simply and economically a cylinder section 1 provided with a step section 37. FIGS. 3*b* and 3*c* show intermediate forms 33 and 34. The upper, expanded section 35 of the cylinder 1 accepts the first stage of the refrigerator. The lower section 36 having reduced diameter accepts the second, smaller stage of the refrigerator. A separate welding of the floor 3 is again eliminated.

Although this invention has been described with reference to specific embodiments, it will be apparent to those of ordinary skill in the art that various changes may be made therein without departing from the scope and spirit of the invention as set forth in the appended claims.

I claim:

1. A method for manufacturing a refrigerator housing of a refrigerator cold head from a plurality of component parts including at least one cylindrical wall, said method comprising the following steps:

providing said at least one cylindrical wall as first and second cylindrical walls of unequal diameter; and providing a step section connecting said first and second cylindrical walls;

wherein said walls, step section, and floor are manufactured by a cold working process as a continuous, integral unit from a single piece of material.

2. The method of claim 1, wherein the step of manufacturing is further defined by manufacturing said walls, step section, and floor by a cold-working process selected from a group consisting of ironing, stretching pressure rolling, and deep-drawing.

3. The method of claim 1, wherein the step of manufacturing is further defined by selecting ironing as the cold-working process.

4. The method of claim 3, further comprising the following steps:

providing, among said component parts, an annular fitting piece and a pot-shaped part; and closing a second end of said at least one cylindrical wall with said annular fitting piece and said pot-shaped part.

5. The method of claim 4, further comprising the following steps:

providing the second end of said at least one cylindrical wall with a circumferentially extending edge;

providing said annular fitting piece with first and second circumferentially extending edges;

providing said pot-shaped part with a circumferentially extending edge;

welding the circumferentially extending edge of said at least one cylindrical wall to the first circumferentially extending edge of said annular fitting piece; and welding the second circumferentially extending edge of said annular fitting piece to the circumferentially extending edge of said potshaped part.

6. The method of claim 4, wherein said pot-shaped part serves as a guide cylinder for a drive piston provided at a displacer of said refrigerator cold head.

7. A method for manufacturing a refrigerator housing of a refrigerator cold head from a plurality of component parts including at least one cylindrical wall, said method comprising the following steps:

manufacturing said at least one cylindrical wall from a tube section by a cold-working process;

providing, among said component parts, means for closing a first end of said refrigerator housing;

manufacturing said means for closing a first end by deep-drawing; and soldering or welding said component parts to one another.

8. The method of claim 7, further comprising the following steps:

providing, among said component parts, an annular fitting piece and a pot-shaped part;

closing a second end of said at least one cylindrical wall with said annular fitting piece and said pot-shaped part.

9. The method of claim 8, further comprising the following steps:

providing the second end of said at least one cylindrical wall with a circumferentially extending edge;

providing said annular fitting piece with first and second circumferentially extending edges;

providing said pot-shaped part with a circumferentially extending edge;

welding the circumferentially extending edge of said at least one cylindrical wall to the first circumferentially extending edge of said annular fitting piece; and welding the second circumferentially extending edge of said annular fitting piece to the circumferentially extending edge of said pot-shaped part.

10. The method of claim 8, wherein serves as a guide cylinder for a drive piston provided at a displacer of said refrigerator cold head.

11. A method for manufacturing a refrigerator housing of a refrigerator cold head from a plurality of component parts including at least one cylindrical wall, said method comprising the following steps:

providing, among said component parts, a floor to close a first end of said at least one cylindrical wall; and manufacturing by a cold-working process said at least one cylindrical wall and said floor as a continuous, integral unit from a single piece;

wherein the step of manufacturing is further defined by selecting ironing as the cold-working process;

providing, among said component parts, an annular fitting piece and a potshaped part; and providing the second end of said at least one cylindrical wall with a circumferentially extending edge;

providing said annular fitting piece with first and second circumferentially extending edges;

providing said pot-shaped part with a circumferentially extending edge;

closing a second end of said at least one cylindrical wall with said annular fitting piece and said pot-shaped part by welding the circumferentially extending edge of said at least one cylindrical wall to the first circumferentially extending edge of said annular fitting piece; and welding the second circumferentially extending edge of said annular fitting piece to the circumferentially extending edge of said pot-shaped part.

* * * * *